US005865024A

United States Patent [19]

Kress et al.

[11] Patent Number: 5,865,024

[45] Date of Patent: Feb. 2, 1999

[54] DUAL FUEL MIXER FOR GAS TURBINE COMBUSTOR

[75] Inventors: Eric J. Kress, Loveland; Narendra D. Joshi, Cincinnati, both of Ohio

[73] Assignee: General Electric Company, Cincinnati, Ohio

[21] Appl. No.: 783,521

[22] Filed: Jan. 14, 1997

[51] Int. Cl.[6] ..... F23R 3/32

[52] U.S. Cl. ..... 60/39.463; 60/737; 60/748

[58] Field of Search ..... 60/39.463, 737, 60/746, 747, 748

[56] References Cited

U.S. PATENT DOCUMENTS

| | | | |
|---|---|---|---|
| 3,713,588 | 1/1973 | Sharpe | 60/748 |
| 5,062,792 | 11/1991 | Maghon | 60/39.463 |
| 5,165,241 | 11/1992 | Joshi et al. | 60/737 |
| 5,251,447 | 10/1993 | Joshi et al. | 60/737 |
| 5,351,477 | 10/1994 | Joshi et al. | 60/39.463 |
| 5,404,711 | 4/1995 | Rajput | 60/39.463 |
| 5,408,825 | 4/1995 | Foss et al. | 60/39.463 |
| 5,675,971 | 10/1997 | Angel et al. | 60/39.463 |

*Primary Examiner*—Louis J. Casaregola
*Attorney, Agent, or Firm*—Andrew C. Hess; David L. Narciso

[57] ABSTRACT

A dual fuel mixer is disclosed as including a mixing duct having an upstream end, a downstream end, and a centerline axis therethrough, where the mixing duct has a circular cross-section defined by a wall. A shroud surrounds the upstream end of the mixing duct and contains therein a gas manifold in flow communication with a gas fuel supply and control. A set of inner and outer annular counter-rotating swirlers are located adjacent the upstream end of the mixing duct for imparting swirl to an air stream. The outer annular swirler includes hollow vanes with internal cavities which are in flow communication with the gas manifold, the outer swirler vanes also having a plurality of gas fuel passages therethrough in flow communication with the internal cavities to inject gas fuel into the air stream. A hub is provided for separating the inner and outer annular swirlers to allow independent rotation thereof. A fuel injector is substantially aligned with the centerline axis for injecting liquid fuel axially into the upstream end of the mixing duct. High pressure air from a compressor is injected into the mixing duct through the inner and outer swirlers to form an intense shear region so that gas fuel injected into the mixing duct from the outer swirler vane passages and/or liquid fuel injected into the mixing duct from the fuel injector are uniformly mixed therein, whereby minimal formation of pollutants is produced when the fuel/air mixture is exhausted out the downstream end of the mixing duct into the combustor and ignited.

12 Claims, 5 Drawing Sheets

DUAL FUEL MIXER FOR GAS TURBINE COMBUSTOR

BACKGROUND OF THE INVENTION

1. Field of the Invention

The present invention relates generally to an air fuel mixer for the combustor of a gas turbine engine and, more particularly, to a dual fuel mixer for the combustor of a gas turbine engine which uniformly mixes either liquid and/or gaseous fuel with air so as to reduce NOx formed by the ignition of the fuel/air mixture.

2. Description of Related Art

Air pollution concerns worldwide have led to stricter emissions standards requiring significant reductions in gas turbine pollutant emissions, especially for industrial and power generation applications. Nitrogen Oxides (NOx), which are a precursor to atmospheric pollution, are generally formed in the high temperature regions of the gas turbine combustor by direct oxidation of atmospheric nitrogen with oxygen. Reductions in gas turbine emissions of NOx have been obtained by the reduction of flame temperatures in the combustor, such as through the injection of high purity water or steam in the combustor. Additionally, exhaust gas emissions have been reduced through measures such as selective catalytic reduction. While both the wet techniques (water/steam injection) and selective catalytic reduction have proven themselves in the field, both of these techniques require extensive use of ancillary equipment. Obviously, this drives the cost of energy production higher. Other techniques for the reduction of gas turbine emissions include "rich burnt quick quench, lean burn" and "lean premix" combustion, where the fuel is burned at a lower temperature.

In a typical aero-derivative industrial gas turbine engine, fuel is burned in an annular combustor. The fuel is metered and injected into the combustor by means of multiple nozzles along with combustion air having a designated amount of swirl. Until recently, no particular care has been exercised in the prior art in the design of the nozzle or the dome end of the combustor to mix the fuel and air uniformly to reduce the flame temperatures. Accordingly, non-uniformity of the air/fuel mixture causes the flame to be locally hotter, leading to significantly enhanced production of NOx.

In the typical aircraft gas turbine engine, flame stability and engine operability dominate combustor design requirements. This has in general resulted in combustor designs with the combustion at the dome end of the combustor proceeding at the highest possible temperatures at stoichiometric conditions. This, in turn, leads to large quantities of NOx being formed in such gas turbine combustors since it has been of secondary importance.

While premixing ducts in the prior art have been utilized in lean burning designs, they have been found to be unsatisfactory due to flashback and auto-ignition considerations for modem gas turbine applications. Flashback involves the flame of the combustor being drawn back into the mixing section, which is most often caused by a backflow from the combustor due to compressor instability and transient flows. Auto-ignition of the fuel/air mixture can occur within the premixing duct if the velocity of the air flow is not fast enough, i.e., where there is a local region of high residence time. Flashback and auto-ignition have become serious considerations in the design of mixers for aero-derivative engines due to increased pressure ratios and operating temperatures. Since one desired application of the present invention is for the LM6000 gas turbine engine, which is the aero-derivative of General Electric's CF6-80C2engine, these considerations are of primary significance.

U.S. Pat. No. 5,251,447 to Joshi et al., which is owned by the assignee of the present invention, describes an air fuel mixer in which gaseous fuel is injected into the mixing duct thereof by means of passages in the vanes of an outer swirler. This concept was also utilized in U.S. Pat. No. 5,351,477 to Joshi et al, which is also owned by the assignee of the present invention, along with a separate manifold and passage through a hub between the outer and inner swirlers to provide dual fuel (gaseous and/or liquid) capability to the air fuel mixer. It has further been disclosed in three related applications, each entitled "Dual Fuel Mixer For Gas Turbine Combustor" and having Serial Nos. 08/581,813, 08/581,817, and 08/581,818, that liquid fuel alternatively may be provided radially to the mixing duct via certain passage configurations in a centerbody of the air fuel mixer. In each of these air fuel mixer designs, a centerbody is provided with the mixing duct thereof. It has been found that complex air flow may cause recirculation zones to form within the mixing duct which create a greater probability of flashback or autoignition along the centerbody.

Accordingly, it would be desirable for an air fuel mixer to be developed for the combustor of a gas turbine engine which has the capability of mixing gaseous and/or liquid fuel therein without the flashback/autoignition problems associated with having a centerbody in the mixing duct thereof.

SUMMARY OF THE INVENTION

In accordance with one aspect of the present invention, a dual fuel mixer is disclosed as including a mixing duct having an upstream end, a downstream end, and a centerline axis therethrough, where the mixing duct has a circular cross-section defined by a wall. A shroud surrounds the upstream end of the mixing duct and contains therein a gas manifold in flow communication with a gas fuel supply and control. A set of inner and outer annular counter-rotating swirlers are located adjacent the upstream end of the mixing duct for imparting swirl to an air stream. The outer annular swirler includes hollow vanes with internal cavities which are in flow communication with the gas manifold, the outer swirler vanes also having a plurality of gas fuel passages therethrough in flow communication with the internal cavities to inject gas fuel into the air stream. A hub is provided for separating the inner and outer annular swirlers to allow independent rotation thereof. A fuel injector is substantially aligned with the centerline axis for injecting liquid fuel axially into the upstream end of the mixing duct. High pressure air from a compressor is injected into the mixing duct through the inner and outer swirlers to form an intense shear region so that gas fuel injected into the mixing duct from the outer swirler vane passages and/or liquid fuel injected into the mixing duct from the fuel injector are uniformly mixed therein, whereby minimal formation of pollutants is produced when the fuel/air mixture is exhausted out the downstream end of the mixing duct into the combustor and ignited.

BRIEF DESCRIPTION OF THE DRAWING

While the specification concludes with claims particularly pointing out and distinctly claiming the present invention, it is believed the same will be better understood from the following description taken in conjunction with the accompanying drawing in which:

DETAILED DESCRIPTION OF THE INVENTION

Figure 1:
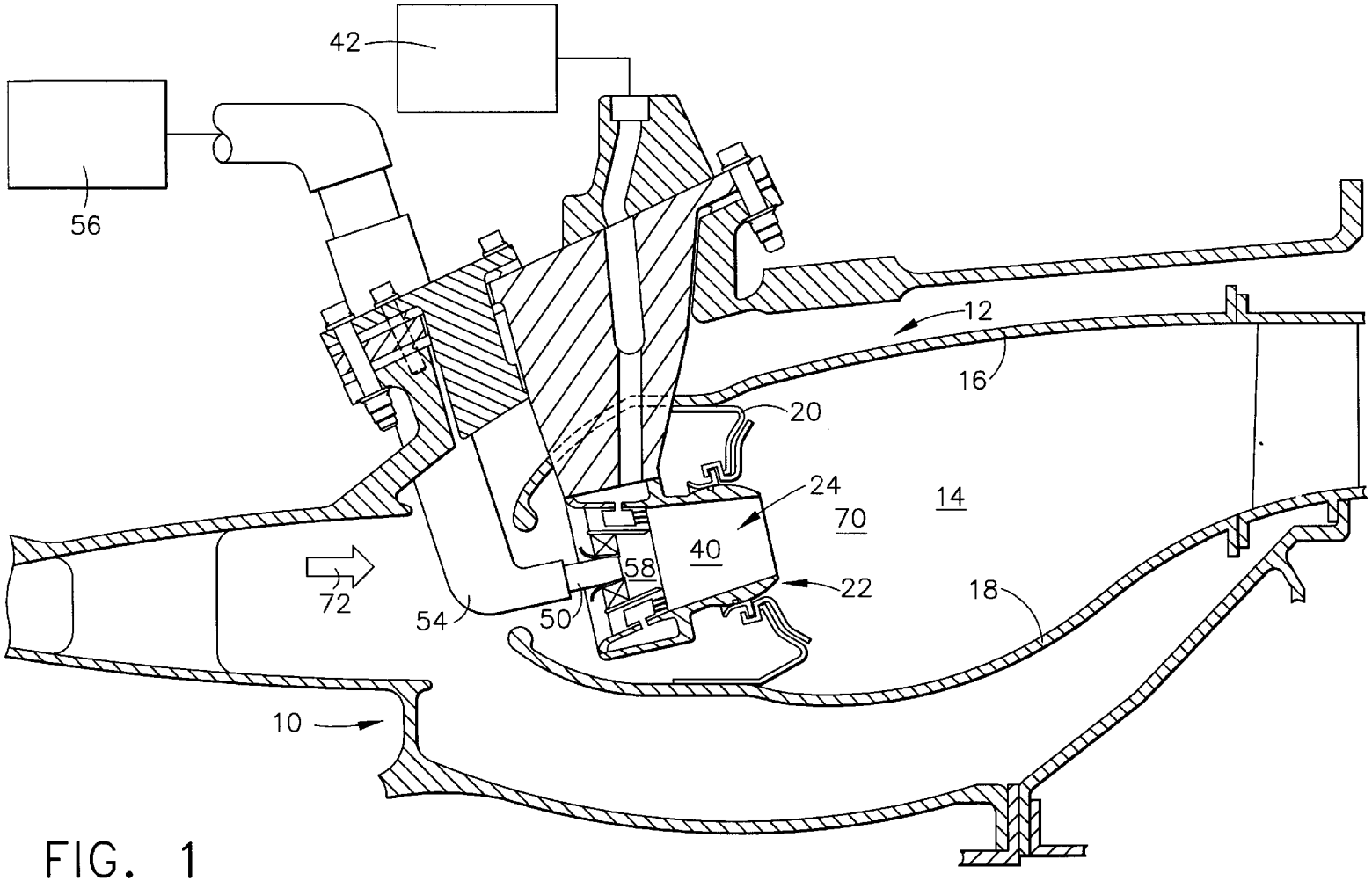
FIG. 1 is a longitudinal cross-sectional view through a single annular combustor structure including the air fuel mixer of the present invention.

Referring now to the drawing in detail, wherein identical numerals indicate the same elements throughout the figures, FIG. 1 depicts a continuous burning combustion apparatus 10 of the type suitable for use in a gas turbine engine and comprising a hollow body 12 defining a combustion chamber 14 therein. Hollow body 12 is generally annular in form and is comprised of an outer liner 16, an inner liner 18, and a domed end or dome 20. It should be understood, however, that this invention is not limited to such an annular configuration and may well be employed with equal effectiveness in combustion apparatus of the well-known cylindrical can or cannular type, as well as combustors having a plurality of annuli. In the present annular configuration, the domed end 20 of hollow body 12 includes a swirl cup 22, having disposed therein a dual fuel mixer 24 of the present invention to allow the uniform mixing of gas and/or liquid fuel and air therein. Accordingly, the subsequent introduction and ignition of the fuel/air mixture in combustion chamber 14 causes a minimal formation of pollutants. Swirl cup 22, which is shown generally in FIG. 1, is made up of mixer 24 and the swirling means described below.

Figure 2:
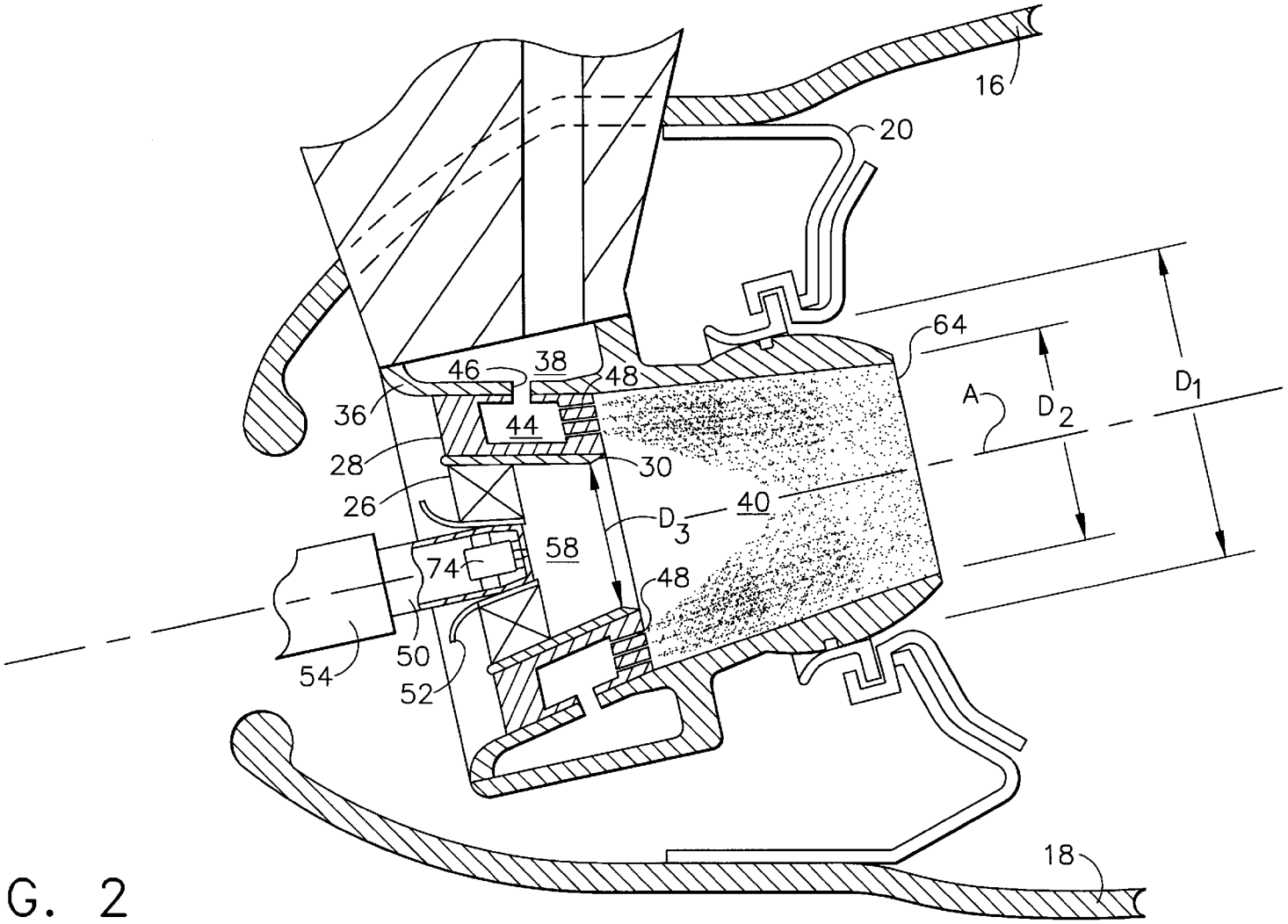
FIG. 2 is an enlarged cross-sectional view of the air fuel mixer of the present invention and combustor dome portion of FIG. 1 which depicts gaseous fuel being injected therein.
Figure 3:
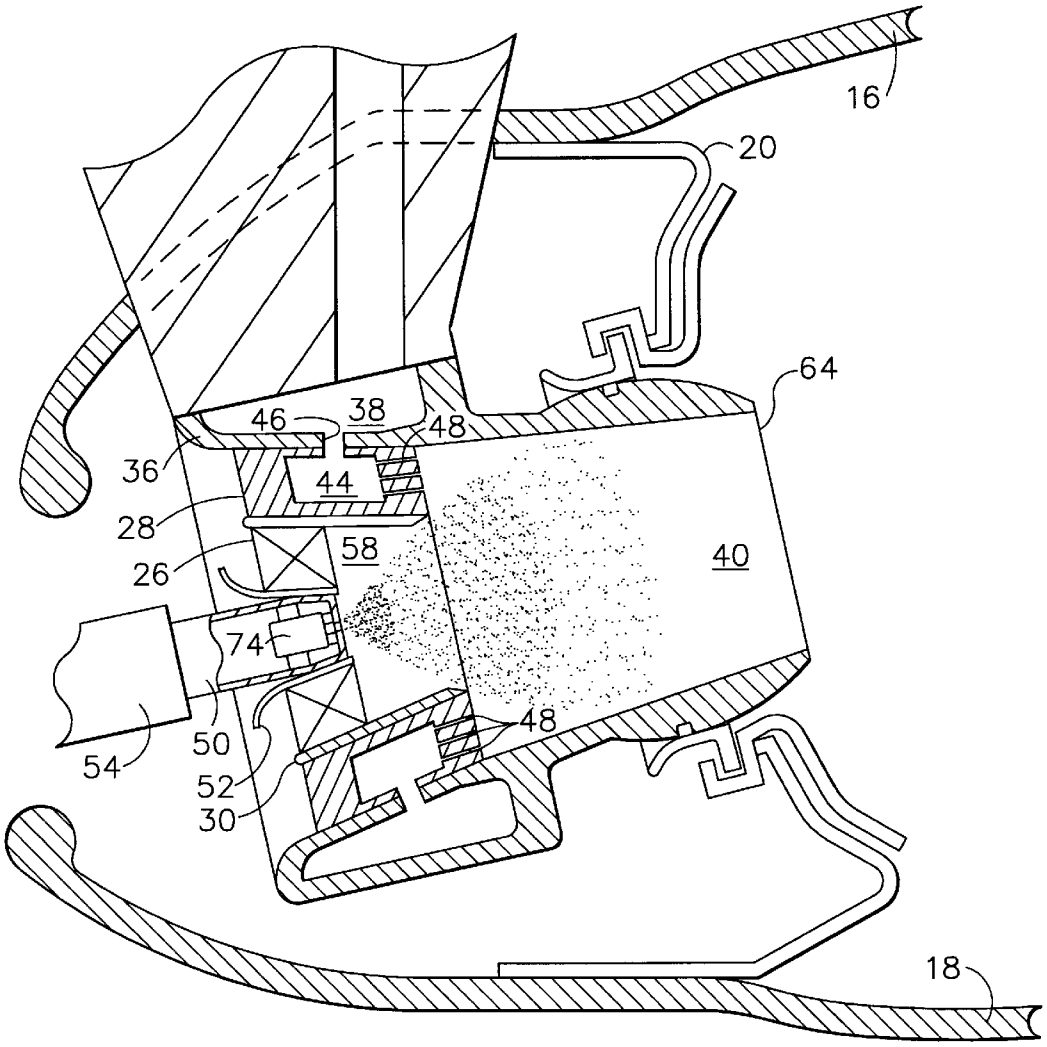
FIG. 3 is an enlarged cross-sectional view of the air fuel mixer of the present invention and combustor dome portion of FIG. 1 which depicts the liquid fuel being injected therein.
Figure 4:
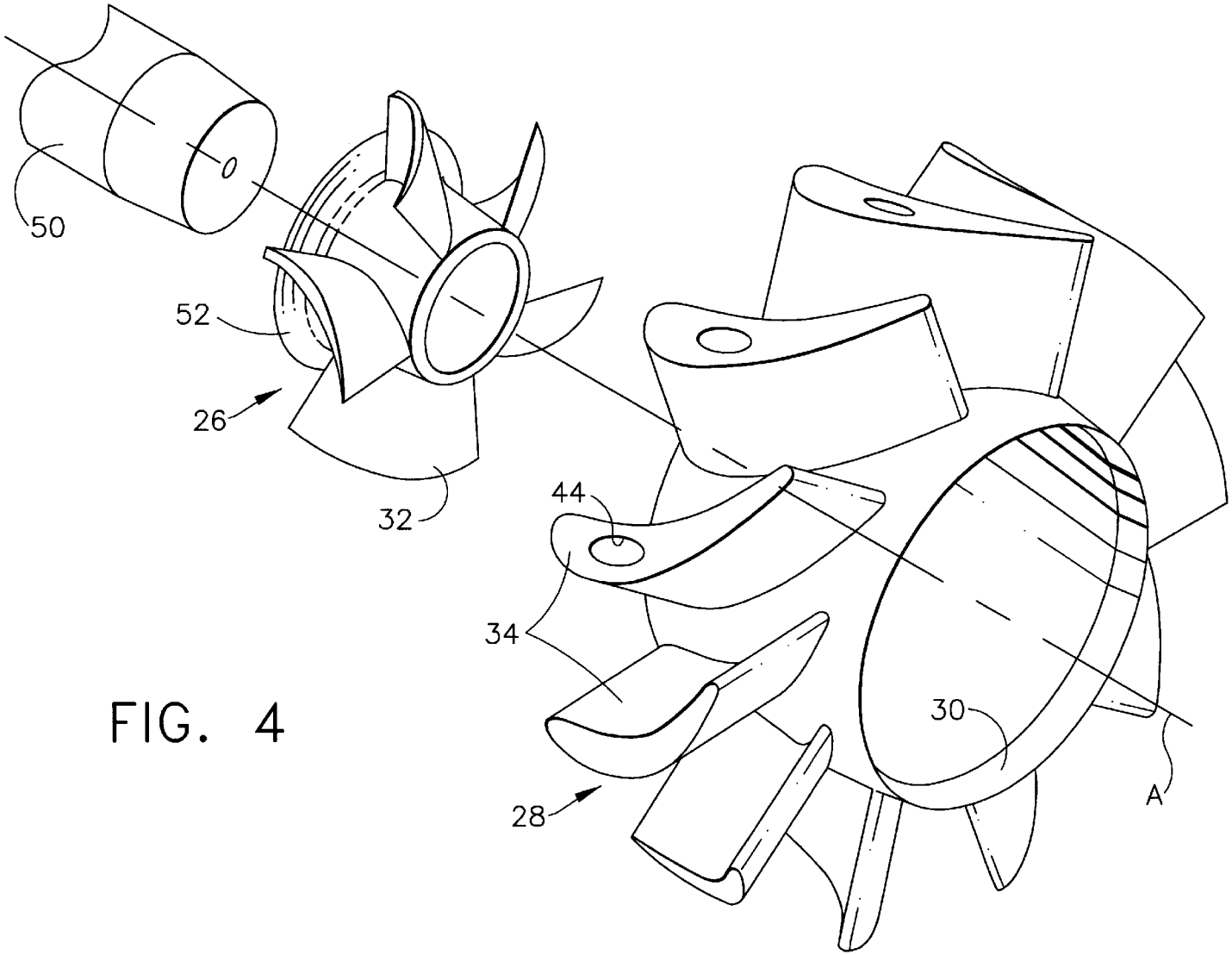
FIG. 4 is an exploded perspective view of the outer swirler, the inner swirler, and the fuel injector shown in FIGS. 1, 2, and 3.

As seen in FIGS. 1–3 and 5, mixer 24 includes an inner swirler 26 and an outer swirler 28 which are brazed or otherwise set in swirl cup 22, where inner and outer swirlers 26 and 28 preferably are counter-rotating (see, e.g., orientation of their respective vanes in FIG. 3 of U.S. Pat. No. 5,351,477, which is hereby incorporated herein by reference). It is of no significance which direction inner swirler 26 and outer swirler 28 causes air to rotate so long as it does so in opposite directions. Inner and outer swirlers 26 and 28 are separated by a hub 30, which allows them to be co-annular and separately rotate the air therethrough. It will be understood that swirlers 26 and 28 have vanes 32 and 34 (see FIG. 4) preferably at an angle in the 40°–60° range with a centerline axis A running through the center of mixer 24. Also, the air flow ratio between inner swirler 26 and outer swirler 28 is preferably approximately 1:3.

As seen in FIGS. 1–3, a shroud 36 is provided which surrounds mixer 24 at the upstream end thereof with a gas fuel manifold 38 contained therein. Downstream of inner and outer swirlers 26 and 28 is an annular mixing duct 40, which preferably is frusto-conical in shape and has an upstream end diameter $D_1$ and a downstream end diameter $D_2$, where diameter $D_1$ is greater that diameter $D_2$. Gas fuel manifold 38 is in flow communication with vanes 34 of outer swirler 28 and is metered by an appropriate fuel supply and control mechanism 42 as disclosed in the above prior art patents. Although not depicted in the figures, it will be understood that gas fuel manifold 38 may be altered so as to be in flow communication with vanes 32 of inner swirler 26. More particularly, it will be understood that vanes 34 are of a hollow design in accordance with U.S. Pat. No. 5,351,477 where an internal cavity 44 is located therethrough adjacent the larger leading edge portion thereof and is in flow communication with gas fuel manifold 38 via a passage 46 in shroud 36. Each of vanes 34 preferably has a plurality of passages 48 from internal cavity 44 to the trailing edge of such vane. As best seen in FIG. 2, passages 48 are utilized to inject gaseous fuel into the air stream in mixing duct 40 so as to improve macromixing of the fuel with the air. Gas fuel passages 48 may also extend from vane internal cavity 44 either a distance downstream or merely through a leading edge portion to terminate substantially perpendicular to a pressure surface or a suction surface of vane 34.

Contrary to the prior designs of similar mixers, dual fuel mixer 24 of the present invention does not include a centerbody which extends downstream through mixing duct 40. Because it has been found that complex air flow may form undesirable recirculation zones within mixing duct 40 which increases the likelihood of flashback and/or auto-ignition along such a centerbody, mixer 24 instead utilizes a fuel injector 50 located generally along centerline axis A and removably affixed to a retainer 52 at the interior of inner swirler 26. It will be seen in FIGS. 1—3 that fuel injector 50 is connected to a fuel nozzle 54 which is connected in flow communication with a liquid fuel supply and control mechanism 56 (see FIG. 1). In this way, liquid fuel is injected axially along centerline axis A into mixing duct 40.

With respect to the physical relationship between fuel injector 50, inner swirler 26 and outer swirler 28, it will be seen that fuel injector 50 extends axially to about the downstream end of inner swirler 26. Outer swirler 28 and hub 30 extend further downstream into mixing duct 40 than inner swirler 26 (preferably having an axial length 2–4 times the axial length of inner swirler 26) so that a throat 58 is defined between the downstream end of inner swirler 26 and the downstream end of outer swirler 28/hub 30. Accordingly, throat 58 will preferably have an axial length at least as great as the axial length of inner swirler 26. In order to promote flow speed through throat 58, it is preferred that outer swirler 28 and hub 30 be substantially conical in shape (thereby causing throat 58 to be substantially conical). Inner swirler 26 also may be substantially conical so as to mechanically fit better with outer swirler 28 and hub 30. It will be further noted that a diameter $D_3$ exists at the downstream end of throat 58, which preferably is approximately one-third to two-thirds the size of diameter $D_2$ for the downstream end of mixing duct 40. In effect, the geometry of outer swirler 28, hub 30, inner swirler 26, and mixing duct 40 eliminates the problems of flashback and auto-ignition by maintaining air velocities higher than the turbulent flame speed at all points within mixer 24. In this regard, the downstream end of hub 30 preferably has a chamfered edge and the trailing edges of inner and outer annular swirler vanes 32 and 34 preferably are sharp to minimize the aft-facing recirculation zones therefrom.

Figure 5:
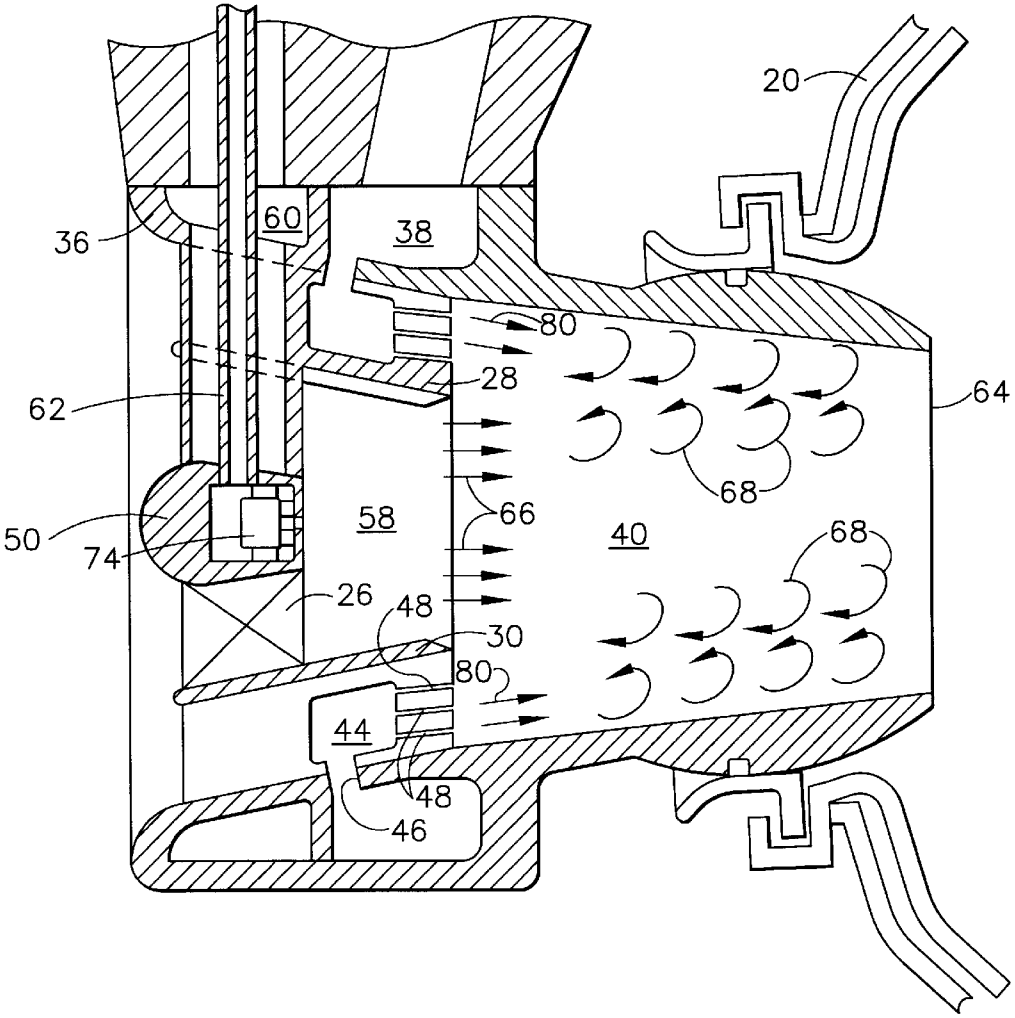
FIG. 5 is an enlarged cross-sectional view of the air fuel mixer depicted in FIGS. 1—3 with an alternative arrangement for providing liquid fuel to the fuel injector.

While liquid fuel is shown as being supplied through fuel nozzle 54 in FIGS. 1–3, FIG. 5 depicts an alternative arrangement in which a liquid fuel manifold 60 is also provided in shroud 36. A passage generally identified by the numeral 62 is in flow communication with liquid fuel manifold 60 and extends through shroud 36, outer swirler vanes 34, hub 30, and inner swirler vanes 32 so as to supply liquid fuel to fuel injector 50. This configuration permits fuel injector 50 to be integral with mixer 24. As seen in FIG. 5, passage 62 will normally extend through outer swirler vanes 34 upstream of internal cavity 44 therein due to the relative axial lengths of inner and outer swirlers 26 and 28 and to minimize the length of passages 48 in outer swirler vanes 34. However, liquid fuel manifold 60 may be positioned within gas fuel manifold 38, with passage 62 extending through internal cavity 44 of outer swirler vanes 34 in order to provide insulation to passage 62 and help prevent coking of the liquid fuel therein.

Regardless of which manner is used to supply liquid fuel to fuel injector 50, it will be appreciated that fuel injector 50 preferably includes a pressure atomizing device 74 and a plurality of fuel circuits where each fuel circuit may be optimized for a specific operating range of the gas turbine engine. For example, a pilot fuel circuit may be designed for use at low engine power and produce a narrow spray angle to enhance combustor lean blowout or reduce the level of acoustics. A secondary fuel circuit could also be provided for high engine power which would produce fine droplet sizes of liquid fuel in order to promote the most uniform fuel-air mixture.

It will be understood that mixer 24 of combustor 10 may change from operation by gas fuel to one of liquid fuel (and vice versa). During such transition periods, the gas fuel flow rate is decreased (or increased) gradually and the liquid fuel flow rate is increased (or decreased) gradually. Since normal fuel flow rates are in the range of 1000–20,000 pounds per hour, the approximate time period for fuel transition is 0.5–5 minutes. Of course, gas fuel supply and control mechanism 42 and liquid fuel supply and control mechanism 56 monitor such flow rates to ensure the proper transition criteria are followed.

Inner and outer swirlers 26 and 28 are designed to pass a specified amount of air flow, and gas fuel manifold 38 and fuel nozzle 54 liquid fuel manifold 50 are sized to permit a specified amount of fuel flow so as to result in a lean premixture at an exit plane 64 located at the downstream end of mixing duct 40. By "lean" it is meant that the fuel/air mixture contains more air than is required to fully combust the fuel, or an equivalence ratio of less than one. It has been found that an equivalence ratio in the range of 0.4 to 0.7 is preferred.

As shown in FIG. 5, an air stream 66 exiting inner swirler 26 and an air stream 80 exiting outer swirler 28 set up an intense shear layer 68 in mixing duct 40. Shear layer 68 is tailored to enhance the mixing process, whereby fuel flowing through vanes 34 and fuel injector 50 are uniformly mixed with intense shear layer 68 from swirlers 26 and 28, as well as prevent backflow along the inner surface of mixing duct 40. Mixing duct 40 may be a straight cylindrical section, but preferably should be uniformly converging from its upstream end to its downstream end so as to increase fuel velocities and prevent backflow from primary combustion region 70.

In operation, compressed air 72 from a compressor (not shown) is injected into the upstream end of mixer 24 where it passes through inner and outer swirlers 26 and 28 and enters mixing duct 40. Gas fuel is injected into air stream 66 (which includes intense shear layers 68) from passages 48 in vanes 34 in flow communication with gas fuel manifold 38 and is mixed as shown in FIG. 2. Alternatively, liquid fuel is injected into air flow stream 66 from fuel injector 50 and mixed as shown in FIG. 3. At the downstream end of mixing duct 40, the fuel/air mixture is exhausted into primary combustion region 70 of combustion chamber 14 which is bounded by inner and outer liners 18 and 16. The fuel/air mixture then bums in combustion chamber 14, where a flame recirculation zone is set up with help from the swirling flow exiting mixing duct 40. In particular, it should be emphasized that the two counter-rotating air streams emanating from swirlers 26 and 28 form very energetic shear layers 68 where intense mixing of fuel and air is achieved by intense dissipation of turbulent energy of the two co-flowing air streams. The fuel is injected into these energetic shear layers 68 so that macro and micro mixing takes place in a very short region or distance. In this way, the maximum amount of mixing between the fuel and air supplied to mixing duct 40 takes place in the limited amount of space available in an aero-derivative engine.

Having shown and described the preferred embodiment of the present invention, further adaptations of the dual fuel mixer for providing uniform mixing of fuel and air can be accomplished by appropriate modifications by one of ordinary skill in the art without departing from the scope of the invention.

What is claimed is:

1. An apparatus for premixing fuel and air prior to combustion in a gas turbine engine, comprising:

(a) a linear mixing duct having an upstream end, a downstream end, and a centerline axis therethrough, said mixing duct having a circular cross-section defined by a wall;

(b) a shroud surrounding the upstream end of said mixing duct, said shroud having contained therein a gas manifold in flow communication with a gas fuel supply and control means;

(c) a set of inner and outer annular swirlers adjacent the upstream end of said mixing duct for imparting counter-rotating swirl to an air stream, said outer annular swirler including hollow vanes with internal cavities, wherein the internal cavities of said outer swirler vanes are in flow communication with said gas manifold, and said outer swirler vanes having a plurality of gas fuel passages therethrough in flow communication with said internal cavities to inject gas fuel into said counter-rotating air stream;

(d) a hub separating said inner and outer annular swirlers to allow independent rotation of said air stream through said swirlers; and (e) a fuel injector substantially aligned with said centerline axis for injecting liquid fuel axially into the upstream end of said mixing duct;

wherein high pressure air from a compressor is injected into said mixing duct through said inner and outer swirlers to form an intense shear region, and gas fuel is injected into said mixing duct from said outer swirler vane passages and/or liquid fuel is injected into said mixing duct from said fuel injector so that the high pressure air and the fuel is uniformly mixed therein, whereby minimal formation of pollutants is produced when the fuel/air mixture is exhausted out the downstream end of said mixing duct into the combustor and ignited.

2. The apparatus of claim 1, wherein said fuel injector extends axially to about a downstream end of said inner swirler.

3. The apparatus of claim 1, wherein said outer swirler and said hub are substantially conical in shape.

4. The apparatus of claim 1, said outer swirler and said hub extending downstream into said mixing duct past said inner swirler, wherein a throat is defined between an outer radial portion and an inner radial portion, respectively, of said outer swirler and said hub.

5. The apparatus of claim 4, wherein said outer swirler and said hub have an axial length approximately 2–4 times an axial length of said inner swirler.

6. The apparatus of claim 4, wherein said throat has a radial length approximately one-third to two-thirds a radial length for the downstream end of said mixing duct.

7. The apparatus of claim 1, said fuel injector being removably affixed thereto.

8. The apparatus of claim 1, said fuel injector being integral therewith.

9. The apparatus of claim 1, further comprising a liquid fuel supply in flow communication with said fuel injector.

10. The apparatus of claim 9, further comprising a liquid fuel manifold located within said shroud in flow communication with said liquid fuel supply, said liquid fuel manifold being in flow communication with said fuel injector via a passage through said outer swirler, said hub, and said inner swirler.

11. The apparatus of claim 10, wherein said liquid fuel manifold is located within said gas fuel manifold.

12. The apparatus of claim 1, wherein said hub has a chamfer at a downstream end thereof.

* * * * *